US008056459B2

(12) United States Patent
Granger

(10) Patent No.: US 8,056,459 B2
(45) Date of Patent: Nov. 15, 2011

(54) ANTI-LOCK DEVICE AND DYNAMIC BRAKE CONTROL IN A MACHINE AUTOMATICALLY DISTRIBUTING CUT WIPING CLOTHS

(76) Inventor: Maurice Granger, St. Priest en Jarez (FR)

( * ) Notice: Subject to any disclaimer, the term of this patent is extended or adjusted under 35 U.S.C. 154(b) by 401 days.

(21) Appl. No.: 12/438,171

(22) PCT Filed: Aug. 21, 2007

(86) PCT No.: PCT/FR2007/051834

§ 371 (c)(1),
(2), (4) Date: Feb. 20, 2009

(87) PCT Pub. No.: WO2008/025923

PCT Pub. Date: Mar. 6, 2008

(65) Prior Publication Data

US 2009/0255951 A1 Oct. 15, 2009

(30) Foreign Application Priority Data

Aug. 28, 2006 (FR) ..... 06 53485

(51) Int. Cl.
*B65H 51/04* (2006.01)

(52) U.S. Cl. ..... 83/649; 83/949; 242/564.4

(58) Field of Classification Search ..... 83/646, 83/649, 949; 242/564.4, 564.1
See application file for complete search history.

(56) References Cited

U.S. PATENT DOCUMENTS

| | | | | |
|---|---|---|---|---|
| 5,868,343 | A * | 2/1999 | Granger | 242/564.4 |
| 6,474,209 | B1 * | 11/2002 | Granger | 83/649 |
| 6,550,714 | B1 * | 4/2003 | Granger | 242/564.4 |
| 2002/0073819 | A1 * | 6/2002 | Phelps et al. | 83/649 |

FOREIGN PATENT DOCUMENTS

FR 2 778 902 A1 11/1999

OTHER PUBLICATIONS

International Search Report for PCT/FR2007/051834 dated Feb. 26, 2008.

* cited by examiner

*Primary Examiner* — Stephen Choi
(74) *Attorney, Agent, or Firm* — Heslin Rothenberg Farley & Mesiti P.C.

(57) ABSTRACT

A lever, in its gooseneck-shaped top part, has a non-circular, curvilinear internal configuration with a wide gap toward the outside and a perpendicular anchoring ridge in the widest part oriented toward the inside to work together with a span ring made of an elastomer material arranged on an end piece of the receiving end of the mandrel of a spool of material, and a counterweight device, comprising a counterweight cam that works together with the lever with each turn of a drum.

10 Claims, 4 Drawing Sheets

ANTI-LOCK DEVICE AND DYNAMIC BRAKE CONTROL IN A MACHINE AUTOMATICALLY DISTRIBUTING CUT WIPING CLOTHS

CROSS REFERENCE TO RELATED APPLICATIONS

This application is a national stage filing under section 371 of International Application No. PCT/FR2007/0051834 filed on Aug. 21, 2007, and published in French on Mar. 6, 2008 as WO 2008/025923 and claims priority of French application No. 0653485 filed on Aug. 28, 2006, the entire disclosure of these applications being hereby incorporated herein by reference.

BACKGROUND ART

The invention relates to the technical field of dispensing machines for wipe materials made of cellulose wadding, for example for hand wipes, toilet paper, general-purpose wipes and similar uses.

The dispensing machine (1) is of the type comprising in a housing (1*a*) with a protective cover (1*b*), internal end pieces (2-3) that are perpendicular relative to the back wall (1*c*) of said housing, each pair of end pieces being parallel to each other but at different heights. The lower end pieces (2) support a drum (4) that includes the cutting device (5) which is familiar from the Applicant's various patents. The end pieces (3) located on a plane above the above-mentioned end pieces support the wound reel of material. The reel (B) is not in contact with the drum. The lower part (1*d*) of the housing is designed with a longitudinal opening (1*e*) through which the emerging strip of material can pass and be gripped and pulled. The lateral end pieces (2) that support the drum are designed with known means making it possible to eject the cutting blade from the drum towards the rear of the machine. The end of the drum has shafts (4*a*) that rest against and are centred in holes in the above-mentioned end pieces (2). Means of exerting pressure (6) may push against the drum in the manner described in the Applicant's patents. One revolution of the drum is equivalent to one piece of material cut to size.

In practice and because the reel of material is not in contact with the drum, depending on the pulling force (FT) exerted by the user, kinking of the strip of material may occur between the drum and the reel after the drum has rotated one revolution which is equivalent to a piece of wipe material of the predefined size being detached.

In order to overcome this drawback of kinking that can cause the machine to become unserviceable due to jamming, the Applicant has developed very specific anti-kink devices that are described, for instance, in French Patents 2870702, 2860967, 2828083 and 2778902.

In French Patent document number 2870702, transverse pressure rolls are arranged obliquely and come into contact with the lateral edge of the reel in order to fulfil a braking function. However, if the strip is pulled quickly very hard, kinking still occurs because of the inertia of the reel of material (which weighs up to 2 kg).

In French Patent document number 2860967, the anti-kink device which hence brakes the reel of material operates through the hinge pin of the cover relative to the housing acting through a cam mounted on this pin on a swivelling lever that comes into contact against the reel of material.

In French Patent document number 2828083, it is the reel-holder end piece that accommodates a stub support shaft, the stub accommodating an O-ring that penetrates into the reel spool. Means of return as well as geared means are involved in the operation of the device, but in a complex embodiment that is not in use.

Another problem was the fact that it is difficult to separate the last central attached area of the sheet grasped by the user from the reel due to the piece of material between the drum and the reel being insufficiently tensioned during cutting.

The Applicant therefore proposed, in French Patent 2778902, a device, to prevent kinking of a strip of material coming from a reel, which includes a mechanism that acts on the reel holder by locking the latter in position and is actuated by a counterweight device integrated into the movement of the drum to ensure locking or no locking of the reel holder.

In this embodiment, the counterweight device only intervenes if the strip of material is pulled hard.

In this embodiment, the position of the lever locking device underneath the disc that accommodates the stub is random and the locking pin does not necessarily penetrate into one of the indentations formed on the accommodating disc. In addition, this patent also describes the use of a stub that accommodates the spool of the wipe-material reel designed with a central opening that forms a recess accommodating two half thrust flanges that can expand due to the action of means of rolling and are driven by a belt that acts as a brake. As said flanges move apart, they cause the belt to come into contact with the inner part of the spool, thereby locking it.

In practice, additional experiments conducted by the Applicant showed that all these suggested improvements based on the prior art as described above proved inadequate in operation in terms of controlling braking of the reel holder spool because pressure was converted into potential slipping that allowed the braked strip of material to be unwound.

In Patent FR 2778902, the belt surrounding the flanges was not sufficiently reliable and tended to come off when the roll was fitted.

The Applicant's approach was therefore to rethink a new solution that used some of the means described in previous solutions but with different layouts and after optimising certain configurations and components.

The solution devised by the Applicant thus makes it possible to optimise operation of the machine by obtaining complete, instantaneous locking of the reel of wipe material, for every revolution of the drum, without any possibility of slippage due to unpredictable contact pressure, regardless of the pulling force exerted by the user on the strip of material that is to be dispensed. This solution is also advantageous in order to cut the strip of material when a slow, continuous pulling force is exerted.

The Applicant's approach was therefore to propose a device of simple design that achieved particularly effective results compared with the various solutions previously suggested, regardless of the nature of the wipe material used, given the fact that such materials differ enormously in terms of their use and properties, depending on the original manufacturer of the reel of wipe material.

BRIEF SUMMARY OF INVENTION

According to a first aspect, the device to assist braking of the reel of wipe material in a wipe material dispensing machine, the machine being of the type comprising, in a housing with a protective cover, lower end pieces that support the drum including its cutting device and upper end pieces that support the reel of material on its spool, the machine also comprising a device to prevent kinking of the material obtained from the reel, this device including a lever, the top of which partially surrounds the stub that accommodates the spool of the reel and the bottom of which has a counterweight device that is integrated into the movement of the rotating drum, thereby ensuring operation and locking of the reel, the lever being designed with additional means that cooperate with the support stub for the spool of the reel of material, characterised in that the upper gooseneck shaped part of the lever has a non-circular curved internal configuration with an outwardly flaring amplitude and, in its area of maximum amplitude, has an internally oriented perpendicular anchoring hook in order to cooperate by catching in a bead of elastomer material located on the end piece of the stub that accommodates the spool of the reel of material and in that the counterweight device comprises a counterweight that cooperates with the lever each time the drum revolves, thereby ensuring self-locking.

These aspects and others will become apparent from the following description.

BRIEF DESCRIPTION OF THE DRAWING FIGURES

The object of the present invention is described, merely by way of example, in the accompanying drawings in which.

DETAILED DESCRIPTION

In order that the present invention may more readily be understood, the following description is given, merely by way of example, reference being made to the accompanying drawings.

Figure 1:
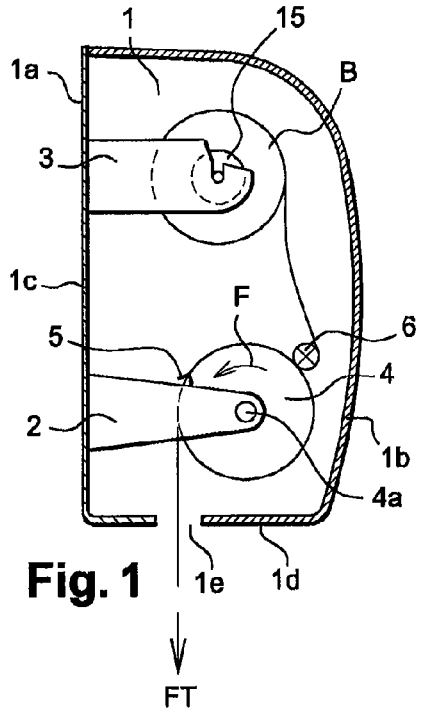
FIG. 1 is a schematic view of a wipe material dispensing machine with automatic cutting capable of including the device according to the invention.

The dispensing machine is of the type described earlier in terms of the essential components that may be concerned by the invention shown in FIG. 1. For the sake of clarity, the enumeration of features is deliberately restricted to the following in order to take into account the way in which the invention is embodied. Obviously, the dispensing machine may be fitted with other additional devices that have, for example, been described in the Applicant's various patents.

The optimised anti-kink device according to the invention uses two special means, namely a lever (10) and a counterweight cam (11) which allow, through their relationship, self-locking of the reel of material each time the drum revolves, regardless whether the strip of material is pulled hard, quickly or slowly, and preventing any possibility of slippage. These two means (10) and (11) interact between drum (4) which contains the device for cutting the reel of material and the device for braking the reel. These two means (10) and (11) in particular are described below.

FIGS. 2, 4A, 4B and 7 show that lever (10) can be positioned so that its gooseneck shaped top (10*a*) is either at the rear of the housing of the machine, i.e. rear inside surface of the end piece that supports stub (12) that fits into the spool of the reel of material or in front of said stub. Said stub (12) therefore comprises an end piece (12*a*) in the form of a disc having around its periphery a groove (12*b*) that accommodates a bead (13) of elastomer material intended to come into contact with lever (10) under conditions that will be specified below.

End piece (12*a*) has a central hole (12*c*) allowing room for a means of connection (14) and a cap (15) having a hollow cylindrical bearing surface (15*a*) capable of penetrating into said central hole (12*c*). End piece (12*a*) has a circular internal cavity (12*d*) in the centre of which there is a circular bearing surface (12*e*) having a smaller cross-section. This bearing surface is designed with at least two opposite-facing curved internal recesses (12*f*) if there are two of them or evenly distributed recesses if there are three of them. The internal recesses (12*f*) are large in size. At least two means of rolling (16) in the form of rollers are located so that they rest against the bottom of the end piece facing said internal recesses. The number of rollers depends how many of the above-mentioned recesses there are. At least two half thrust flanges (17) forming jaws having a substantially oval, non-circular configuration in a ramp shape are fitted and arranged around above-mentioned circular bearing surface (12*e*) and means of rolling (16). At least two such half thrust flanges are interconnected by a split elastic means (18) of the spring type enabling them to be radially connected and moved apart as a function of stresses that will be specified below. Peripherally, the two half thrust flanges, or each of the flange parts if there are several of them, have ridges (17*a*) capable of penetrating into the spool of the reel of material and coming into contact with the latter's internal bore. The cap (15) is fixed on top of the half thrust flanges and rests against the front of circular bearing surface (12*e*) which protrudes substantially beyond the plane of the two half thrust flanges so that the latter can rotate. The two half thrust flanges are located opposite the recessed areas of circular bearing surface (12*e*) in order to allow perfect adjustment by surrounding the means of rolling (16). It is apparent that the half thrust flanges have the particular effect of preventing rotation of the spool of the reel.

The special configuration of lever (10) is explained below. The top gooseneck shaped part (10*a*) of this lever (10) has a curved, non-circular internal configuration (10*b*) with a certain amplitude that gradually flares outwardly with respect to bead (13) located on stub (12) and around which the top (10*a*) of lever (10) is positioned.

According to the invention, the lever has, in the area of maximum amplitude of the curved configuration (10*b*) a hook (10*c*) that faces bead (13) of the stub. This hook is located in a plane that is perpendicular to and inwardly oriented relative to the opposite-facing part of the bead when the lever is actuated so that it bites into the thickness of the bead and causes stoppage of rotation of end piece (12*a*) of stub (12). In this situation, the half thrust flanges which can partially rotate several degrees of the order of 10 to 20°, due to the effect of the strip of material being pulled, are therefore locked in position due to the effect of them being radially moved apart in opposition to rollers (16) because of their displacement which offsets the bottom of openings (12*f*), allowing the half thrust flanges to move apart. Thus, when the strip of material is pulled normally, the stub is rotated in its entirety but, in contrast, there is successive differentiation of stoppage of rotation of the bead support end piece and then the half thrust flanges which in turn move apart in the spool.

Figure 2:
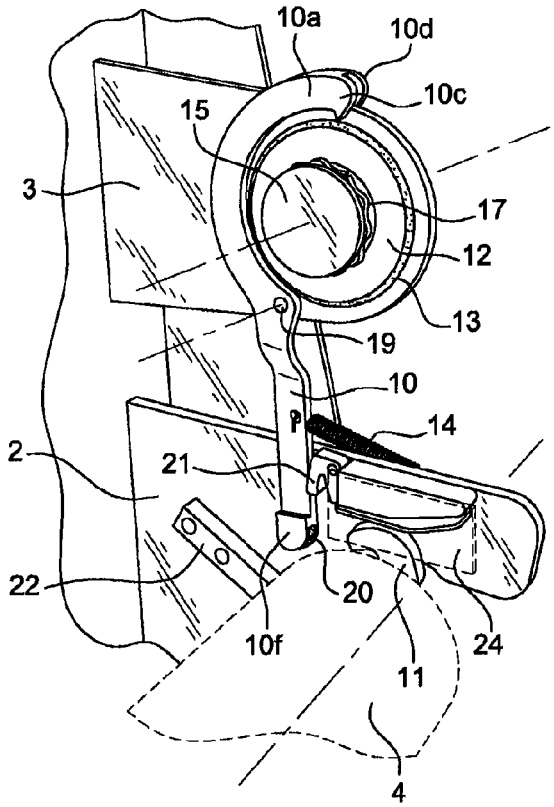
FIG. 2 is a partial view showing the inside of the machine containing the anti-kink device according to the invention in a first embodiment.
Figure 7:
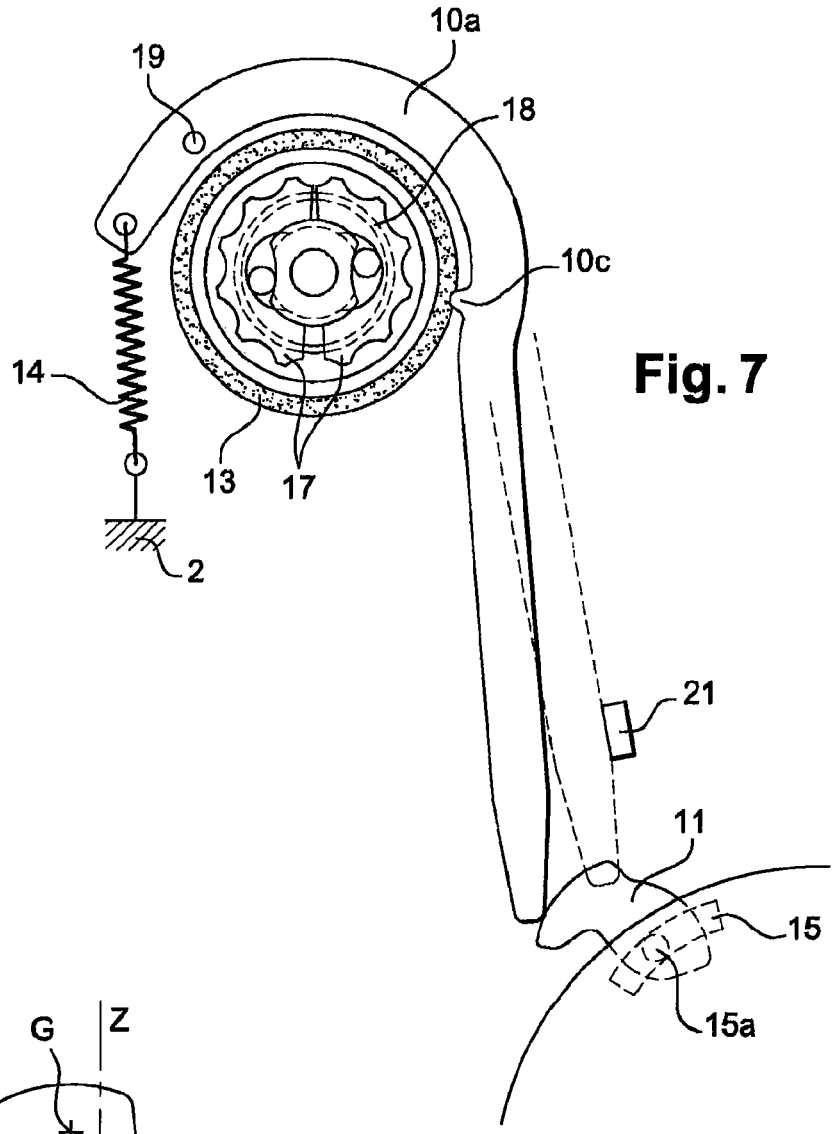
FIG. 7 is a partial view of the anti-kink device according to the invention showing an alternative anti-kink device with the lever positioned and designed differently and of the stub performing its additional reel stopping or braking function.

Anchoring hook (10*c*) may be located close to the end of the top of the lever as shown in FIG. 2 or close to the base of the top of the lever as shown in FIG. 7. In both cases, the position of this hook is very particular in order to allow correct operation of the device. Swivel axis (19) of the lever on support end piece (3) is at the base of the top of the lever if the anchoring hook is located at the end of the top of the lever and, conversely, it is close to the end of the top of the lever if the hook is located close to the base of the top of the lever. In addition, where X-X is the centre line that passes through the swivel axis of the lever and the rotation axis of the stub and line Y-Y passes through the swivel axis of the lever and the end of the anchoring hook, the angle $\alpha$ between the two lines X-X and Y-Y is of the order of 20 to 40 degrees, preferably 30°, and this allows self-locking prior to detachment of the strip of material, after which the lever is released.

It is also possible at the end of the top of the lever, if the anchoring hook is located there, for said profiled top (10*d*) to protrude beyond the thickness of end piece (3), beyond which stub (12) was positioned in order to ensure guidance by a U-shape configuration.

Elastic return of the lever into position is obtained by return means (14) that is attached firstly to lever (10) and secondly to end piece (2) or end piece (3) depending on the embodiment as described above.

The first case corresponds to the anchoring hook being located at the base of the top of the lever and the second case corresponds to the anchoring hook being located at the end of the top of the lever.

The lower end (10*f*) of the lever is extra thick so that it faces the counterweight cam.

Figure 8:
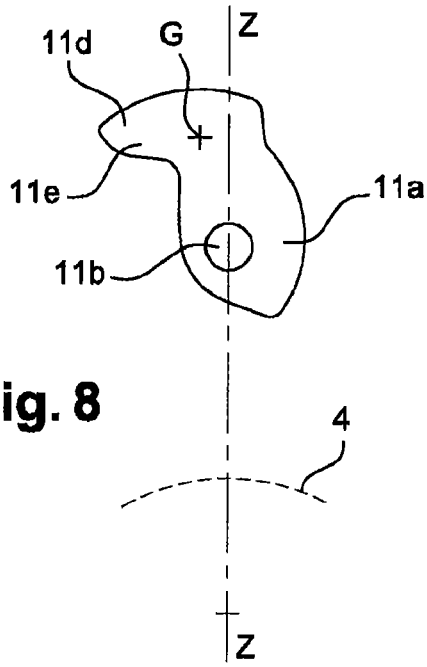
FIG. 8 is a view of the counterweight cam on its own.

The features of the second means, the counterweight cam, which is also involved in actuating the lever, are explained below. The lever has a long leg (10*e*) extending alongside end piece (2) that supports the drum and faces counterweight cam (11) which is mounted so that it can swivel freely relative to a support (15) fitted with a shaft (15*a*) attached to transverse end piece (4*a*) of the end of drum (4) or is moulded with the end piece as a single part. Support (15) is located downstream from the longitudinal slit formed in the drum that allows movement of cutting device (5). Counterweight cam (11) has a special profile which is shown in FIG. 8. It comprises a base (11*a*) with a transverse opening (11*b*) allowing clearance for fixing shaft (15*a*) formed on support (15). Retaining washers prevent the counterweight cam from becoming detached from shaft (15*a*). This base extends outwardly to create a beak configuration (11*e*) with an external curved end part (11*d*) that forms a ramp and cam. Due to the pulling force and the centrifugal force inherent in rotation of the drum, this counterweight cam (11) remains freely outwardly positioned and comes up against lever (10), thereby causing swivelling of said lever and anchoring of the latter in bead (13) located on the stub.

The shape of the counterweight is established so that its centre of gravity (G) is shifted to the rear relative to a line (ZZ) that passes through its axis of rotation and the axis of the drum and this enables it to remain "upright" from the time cutting the previous strip of material finishes until it arrives opposite lever (10) to make the next cut.

The counterweight cam makes contact with the lower leg part (10*f*) of the lever on the latter's opposite-facing edge and there is provision to add a cushion (20) to absorb noise when the counterweight cam makes contact with the leg of the lever. Limit stop (21) attached to end piece (3) limits forward travel of the lever. Limit stop (22) is located underneath the area through which the lower leg of the lever moves and is used as a support for the counterweight cam once it has escaped control by the lever after additional rotation of the drum. Thus, according to the embodiment of the invention, the particular combination of the configuration of the top of the lever and the counterweight cam causes, with each revolution of the drum and as soon as there is contact between them, immediate stoppage of rotation of the reel of material and hence the desired anti-kink effect. This phase is obviously confined to a particular instant in time because disappearance of the pulling force due to cutting causes the counterweight cam to swivel back into its initial idle position with positional swivelling but no extension. The lever returns to its original position.

Figure 3A:
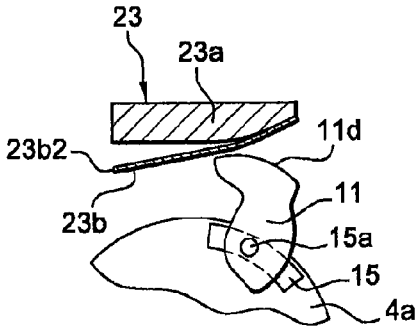
FIGS. 3A and 3B are views that supplement FIG. 2 and show, in particular, in the preferred embodiment, how the counterweight cam is guided by the additional means before it comes into contact with the lever in order to actuate the anti-kink function.
Figure 3B:
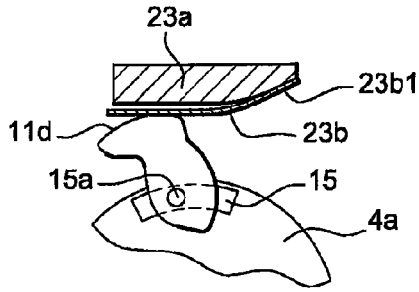
Figure 4B:
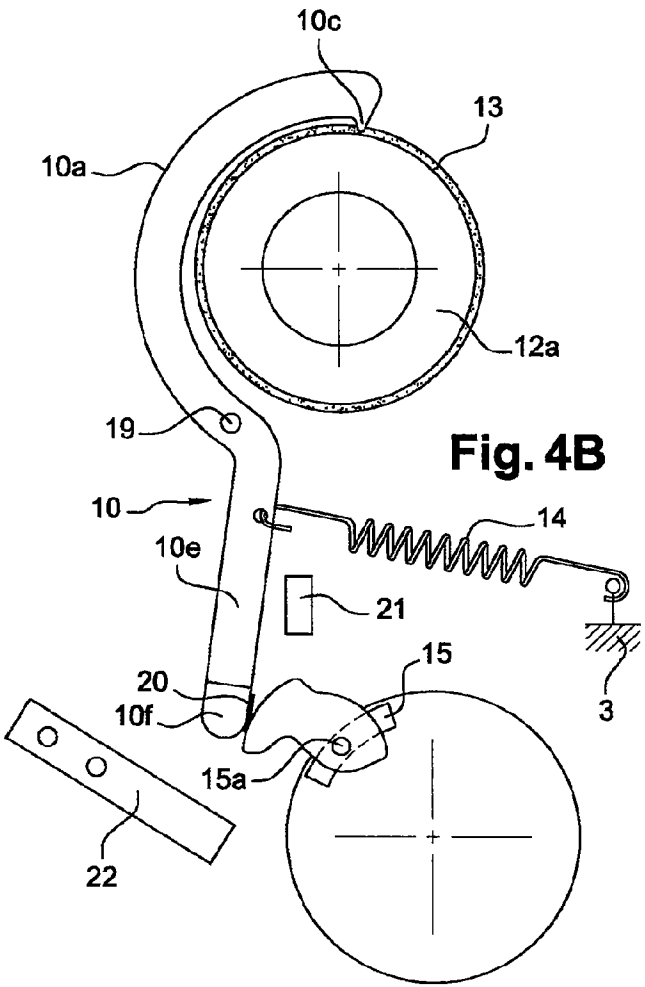
FIGS. 4A and 4B are views showing the anti-kink device according to the invention in the first embodiment's lever configuration and in successive phases where it is not in action and then is in action.
Figure 4A:
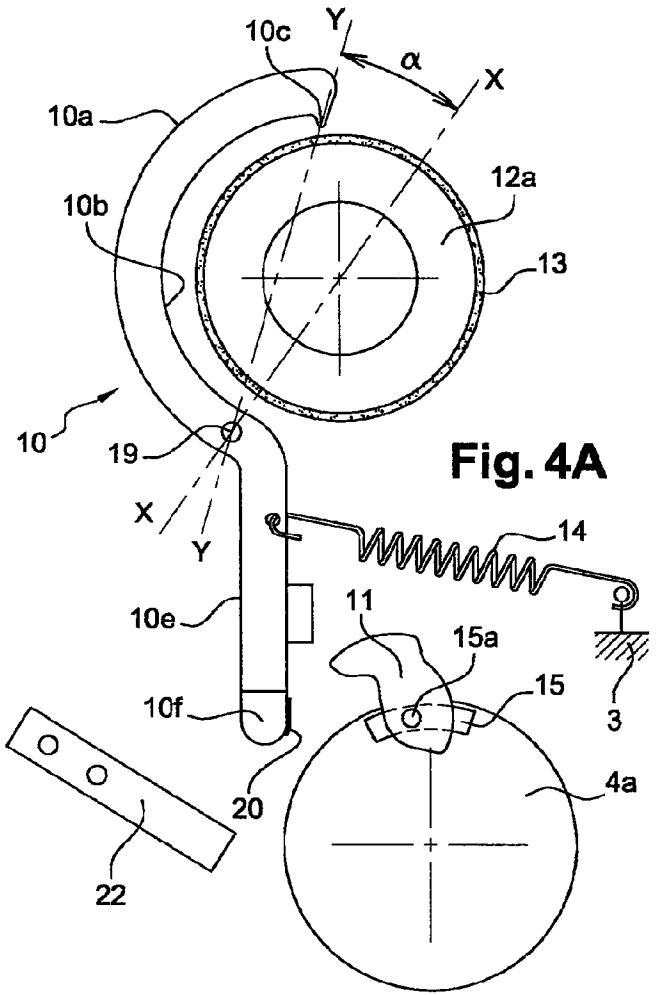
Figure 5:
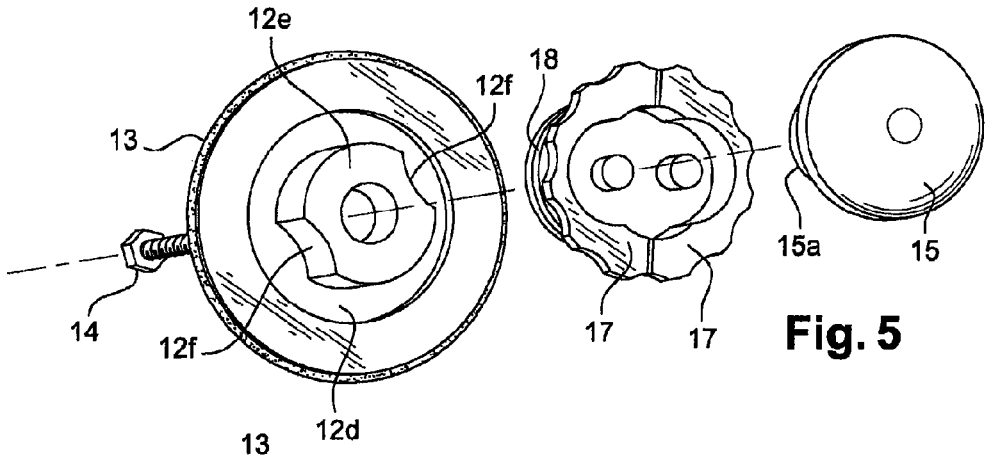
FIG. 5 is an exploded perspective view showing the various components of the stub that penetrates into the spool of the reel of material.
Figure 6A:
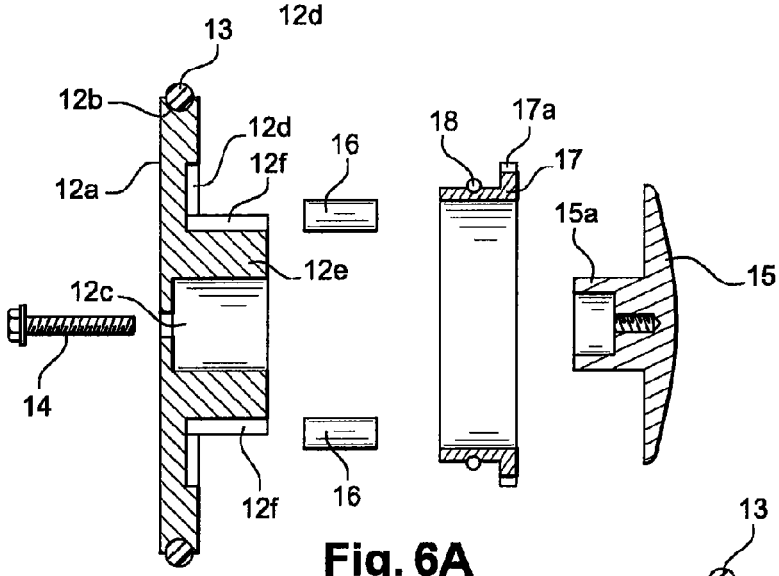
FIGS. 6A and 6B are views, according to FIG. 5, of the components of the stub before and after assembly.
Figure 6B:
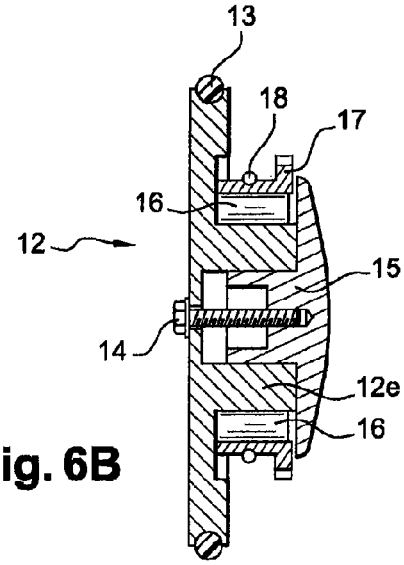

In FIGS. 3A and 3B, the anti-kink device includes an additional means (23) intended to guide the counterweight cam and ensure perfect performance of the latter with each revolution of the drum in order to allow the counterweight cam to be moved automatically onto the leg of lever (10), thereby triggering the reel locking function and avoiding kinking. This additional means comprises at least one fixed component (23*a*) formed or separately mounted on end piece (3). This component ensures attachment of a spring blade (23*b*) shaped like a policeman's hat at one (23*b*1) of its ends. The other end (23*b*2) is unattached and points towards the lever (10) side. This spring blade has a flat cross-section and faces, firstly, the ramp profile (11*d*) of the counterweight cam and, secondly, the underneath edge of fixed component (23*a*).

In this optimised embodiment, the central policeman's hat shaped part of the spring blade is located on the path of the counterweight cam when the drum rotates one revolution. As shown in FIGS. 3A and 3B, when the drum rotates, the counterweight cam is in its upright position, as explained above, and faces the spring blade. With additional partial rotation of the drum, said counterweight cam lifts spring blade (23*b*) and causes slight bending of the spring. This causes tension in the spring blade which has the effect of ensuring pressure against said counterweight cam which is firmly held in position without any tendency to swivel due to the back thrust provided by its rotation support shaft (15*a*) and contact with spring blade (23*b*). This pressure force continues with additional angular rotation of the drum over several degrees and then the counterweight cam escapes spring blade (23*b*) and automatically presses against lever (10) causing it to swivel. Thanks to this additional arrangement, the counterweight cam is necessarily held in its "upright" position prior to making contact with lever (10) which causes positional locking and stoppage of the reel of material thereby providing the desired anti-kink function with each revolution of the drum in order to cut a strip of wipe material. The design of this additional arrangement is simple. As a precaution and in order to prevent any contact or loading of the reel with this means (23) there is provision to fit a transverse guard plate (24).

The solution provided by the invention is extremely effective because it ensures instantaneous locking of the reel of material and is simple to use compared to the prior art with each revolution of the drum, in complete contrast to the prior art.

In addition, the special configuration of the stub with, in particular, the oval shapes of the half thrust flanges and curved shapes on the internal recesses formed on the cylindrical bearing surface make it possible to reverse the position of the reel of material so that it can be unwound from the front or from the rear with a self-locking effect in both cases.

The invention claimed is:

1. Device to assist braking of a reel of wipe material in a wipe material dispensing machine, the machine having, in a housing with a protective cover, lower end pieces that support a rotating drum including a cutting device, upper end pieces that support the reel of material on a spool, and an anti-kinking device to prevent kinking of the material obtained from the reel, said anti-kinking device including a lever and a counterweight cam interacting with the lever each time the drum revolves, the lever having an upper gooseneck shaped part partially surrounding a support stub that accommodates the spool of the reel and a lower end that interacts with the counterweight cam, said cam being articulated on a support attached to a transverse end piece of the rotating drum and being integrated with movement of the rotating drum, the upper gooseneck shaped part of the lever having a non-circular curved internal configuration with an outwardly flaring amplitude and, in an area of maximum amplitude, having an internally oriented perpendicular anchoring hook operative to catch in a bead of elastomer material located on an end piece of the stub thereby ensuring operation and locking of the reel.

2. Device as claimed in claim 1, wherein the lever has a swivel axis on an upper end piece that supports the wipe material reel, and a centre line that passes through the swivel axis of the lever and a rotation axis of the stub, and a line that passes through the swivel axis of the lever and an end of the anchoring hook jointly define an angle of the order of 20° to 40°.

3. Device as claimed in claim 1, wherein the end piece of the stub comprises a disc having a peripheral groove that accommodates the bead of elastomer material, and said end piece has a central hole accommodating a means of connection, the stub further comprising a cap having a hollow cylindrical bearing surface for penetrating into said central hole, said end piece also having a circular internal cavity, with a circular bearing surface of smaller cross-section in a center of said cavity, and said circular bearing surface having at least two curved internal recesses, the stub further comprising rollers that rest against a bottom of the end piece facing said internal recesses, and half thrust flanges forming jaws having a substantially oval, non-circular configuration surrounding the circular bearing surface and said rollers, said half thrust flanges being interconnected by a split elastic means of the spring type, and the half thrust flanges having peripheral ridges for penetrating into the spool of the reel of material when the half thrust flanges are radially moved apart as a function of specific stresses.

4. Device as claimed in claim 1, wherein the counterweight cam comprises a base with a central opening providing clearance for fixing a shaft formed on a support of the counterweight cam, said support being fixed on an outer end piece of the drum.

5. Device as claimed in claim 4, wherein the support of the counterweight cam is located downstream from a longitudinal slit formed in the drum that allows movement of the cutting device.

6. Device as claimed in claim 1, further including a guide member that holds the counterweight cam in an upright position just prior to the cam contacting the lower end of the lever ensuring operation of the anti-kinking device during each revolution of the drum.

7. Device as claimed in claim 6, wherein the guide member comprises at least one fixed component formed or separately mounted on a lower end piece, a spring blade, having one end attached to the fixed component and an other end that is unattached and faces the lever, and wherein the spring blade has a flat cross-section and faces, firstly, a ramp profile of the counterweight cam and, secondly, an underneath edge of the fixed component, and a central part of the spring blade is located on a path of the counterweight cam when the drum rotates one revolution and is elastically deformed when the counterweight cam moves, and deformation of the spring blade has the effect of ensuring pressure against said counterweight cam so that the cam is firmly held in upright position without any tendency to swivel due to a back thrust provided by a rotation support shaft of the counterweight cam and contact with the spring blade.

8. Device as claimed in claim 7, wherein the guide member further comprises a transverse guard plate.

9. Device as claimed in claim 1, further comprising a sound absorbing cushion fitted on an edge of the lower end of the lever.

10. Device as claimed in claim 4, further comprising a first limit stop attached to an upper end piece limiting forward travel of the lever, and a second limit stop located underneath an area through which the lower end of the lever moves, said second limit stop serving as a support for the counterweight cam once the counterweight cam escapes control by the lever after rotation of the drum.

* * * * *